United States Patent [19]

Issenmann

[11] 4,348,171

[45] Sep. 7, 1982

[54] APPARATUS FOR BURNING CRUDE OIL

[76] Inventor: Olivier Issenmann, 4 eme Ave. a, 60260, Lamorlaye, France

[21] Appl. No.: 91,812

[22] Filed: Nov. 6, 1979

[30] Foreign Application Priority Data

Nov. 6, 1978 [FR] France ..... 78 31384

[51] Int. Cl.[3] ..... F23D 13/20

[52] U.S. Cl. ..... 431/202; 431/278; 431/4

[58] Field of Search ..... 431/4, 202, 278

[56] References Cited

U.S. PATENT DOCUMENTS 3,797,992 3/1974 Straitz ..... 431/202
3,807,932 4/1974 Dewald ..... 431/202
3,861,857 1/1975 Straitz ..... 431/202
3,894,831 7/1975 Glotin et al. ..... 431/202
3,950,125 4/1976 McGugan ..... 431/4

*Primary Examiner*—Carroll B. Dority, Jr.
*Attorney, Agent, or Firm*—Wenderoth, Lind & Ponack

[57] ABSTRACT

The invention proposes apparatus for burning crude oil, particularly crude oil derived from oil wells, and which when burned on site by conventional burners can be hazardous in variable wind conditions. The invention proposes apparatus comprising a burner assembly including a plurality of substantially horizontal burners arranged in pairs, means for supplying oil for combustion and compressed air to the burners, and flame control water nozzles characterized in that the assembly is arranged for pivotal displacement about a substantially vertical axis. Thus, the direction of the flames relative to the surrounding environment can be readily adjusted to variations in wind direction.

13 Claims, 3 Drawing Figures

APPARATUS FOR BURNING CRUDE OIL

BACKGROUND OF THE INVENTION

1. Field of the Invention

The present invention relates to apparatus for burning crude oil and has particular application to an apparatus for burning crude oil derived from off-shore oil well installations.

2. Description of the Prior Art

When oil-well production tests are undertaken at sea, it is necessary to dispose of the crude oil collected during such tests, and which oil is frequently contaminated with water, sand, mud and various kinds of waste from the bottom of the well.

Given that production trials generally last from a few hours to a few days, the volume of oil collected, being at most several thousand cubic meters, cannot be dumped into the sea because of the pollution problems caused thereby and does not justify special transport for its evacuation. Further, given that the collecting system for an off-shore oil-well is only installed once the viability of the well has been established, the only economically viable solution is to dispose of the first samples of crude oil collected by on-site combustion.

As stated above this crude oil with its contaminants is a product rich in heavy particles and is far from being easy to burn. Combustion of the oil involves the use of substantial burner means which can handle the combustion of up to 2000 $m^3$ of oil per day and such combustion must be undertaken in conditions of absolute security for both the drilling installation and the drilling team.

A serious disadvantage with conventional burners is that whilst such burners can initially be installed to direct the burner flames and the products of combustion in a safe direction there is always a danger that the wind will adversely affect the flame direction to the detriment of the surrounding environment.

SUMMARY OF THE INVENTION

The present invention seeks to provide apparatus for burning crude oil, capable of being mounted at a safe location and adjustable at such location to afford additional security to the surrounding environment.

Statement of Invention

According to the present invention there is provided apparatus for burning crude oil comprising a burner assembly including a plurality of substantially horizontal burners arranged in pairs, means for supplying oil for combustion and compressed air to the burners, and flame control water nozzles, characterised in that the burner assembly is arranged for pivotal displacement about a substantially vertical axis.

Preferably the burner assembly is pivotally attached to a stand which limits the angular displacement of the assembly about the vertical axis.

Preferably the pivotal displacement of said burner assembly about the vertical axis of limited to 45° to each side of a mid-position for the assembly.

Preferably the burner assembly includes pilot burners for igniting the crude oil burners.

In preferred embodiments of the invention the burner assembly includes valves for controlling the supply of oil to the crude oil burners and/or valves for controlling the supply of compressed air to the crude oil burners and/or valves for controlling the supply of water to the water nozzles.

Preferably each pair of crude oil burners is provided with individual valve controls so that each pair of such burners can be operated independently of other pairs of such burners and conveniently each pair of such burners is supplied with oil and compressed air via common valves, whereby the burners of each pair are arranged to operate simultaneously.

In a preferred embodiment the crude oil or the compressed air or the water is delivered to the burner assembly via a fluid chamber and the vertical pivotal axis of the assembly passes through such chamber. More preferably, more than one fluid is delivered to the burner assembly via fluid chambers, there being a fluid chamber individual to each fluid, and the vertical pivotal axis passes through each fluid chamber.

The, or each, fluid chamber is conveniently formed by upper and lower coupling parts, one of said coupling parts has a fixed position relative to the stand whilst the other said coupling part has a fixed position relative to the burner assembly. The coupling part fixed relative to the stand includes a fluid inlet from a supply source to the chamber and that coupling part fixed relative to the assembly includes a fluid outlet from the chamber to the burner assembly.

Preferably ducts supplying fluids to the assembly pass through said stand with the duct axes in the same vertical plane.

Preferably the burner assembly is contained within a cage and the cage is fixed relative to the burner assembly. The cage may conveniently comprise tubular members defining upper and lower rectangular frames, connected by front and rear upright members and by inclined members, and the rectangular frames are preferably strengthened by diagonal members.

In a preferred example in accordance with the invention apparatus for burning crude oil comprises a burner assembly within a rectangular box-like cage of tubular material fixed relative to the burner assembly, the burner assembly including a plurality of burners arranged with their axes substantially horizontal, the burners being arranged in pairs with one burner of each pair above the other and the pairs of burners being horizontally spaced apart, valve means for controlling the supply of crude oil and compressed air to each pair of burners, a flame control water nozzle adjacent each burner, and fluid supply means for supplying oil, compressed air and water to the burner assembly, the fluid supply means for each fluid including a chamber individual to that fluid and through which the vertical axis passes, and the burner assembly and cage being supported by a fixed stand and mounted for pivotal displacement about a vertical axis relative to the stand.

The, or each, fluid chamber is conveniently formed by upper and lower coupling parts. One of the coupling parts has a fixed position relative to said stand and the other coupling part has a fixed position relative to the burner assembly. The coupling part fixed relative to the stand includes a fluid inlet to chamber from a fluid supply source and the said coupling part fixed relative to the assembly includes a fluid outlet from the chamber to the burner assembly.

The stand may conveniently be in the form of a pedestal with the burner assembly pivotally supported to one side so that when the pedestal is secured at a fixed location, such as a remote and safe part of an oil rig, or a boat or barge adjacent the rig, with the burner assembly in its mean position directed in the most convenient direction for the safety of the rig and attendant personnel, the assembly may be adjusted relative to the stand to accommodate variations in wind direction to maintain the safety of the rig and personnel.

BRIEF DESCRIPTION OF THE DRAWINGS

The invention will now be described further by way of example with reference to the accompanying drawings in which.

DETAILED DESCRIPTION OF THE INVENTION

Figure 1:
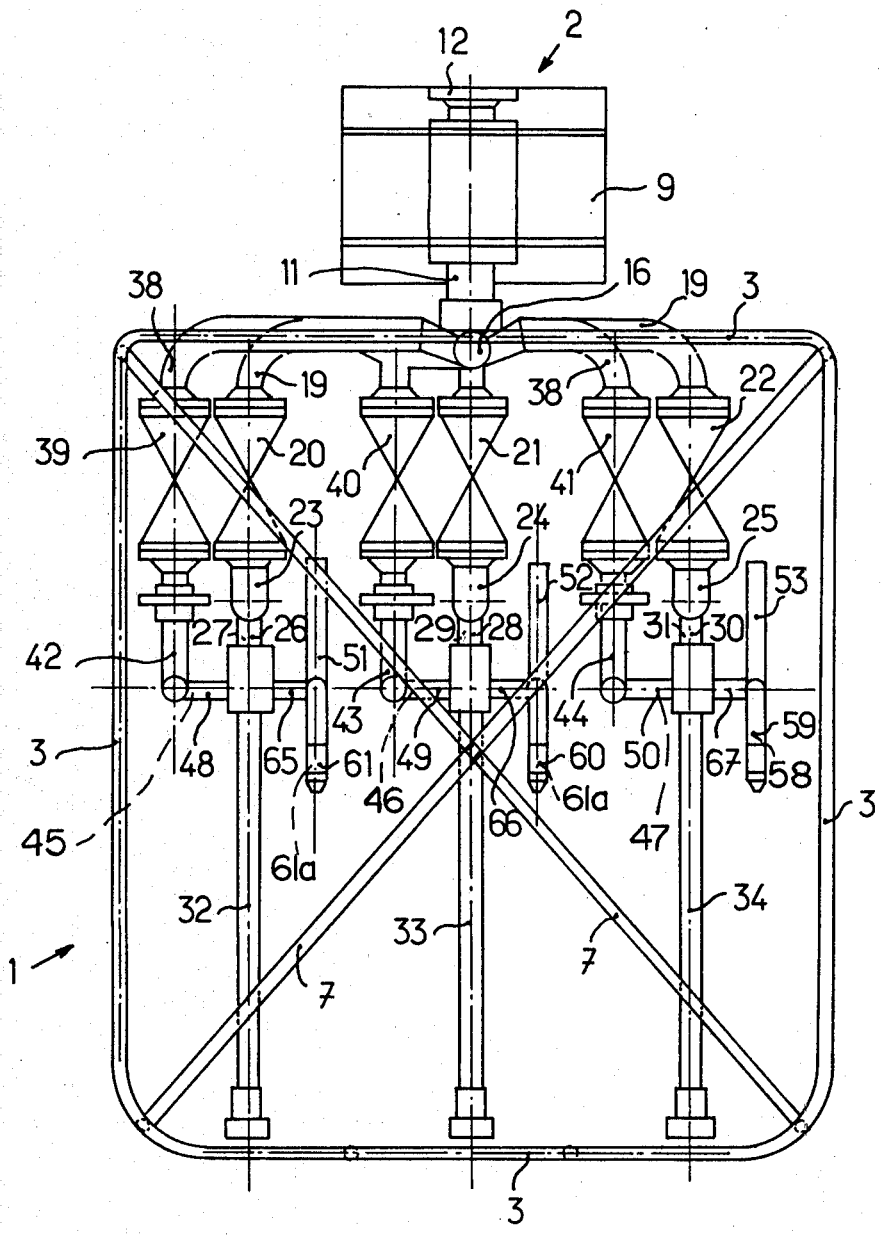
FIG. 1 shows, diagrammatically, a plan view of a burner apparatus in accordance with the invention.
Figure 2:
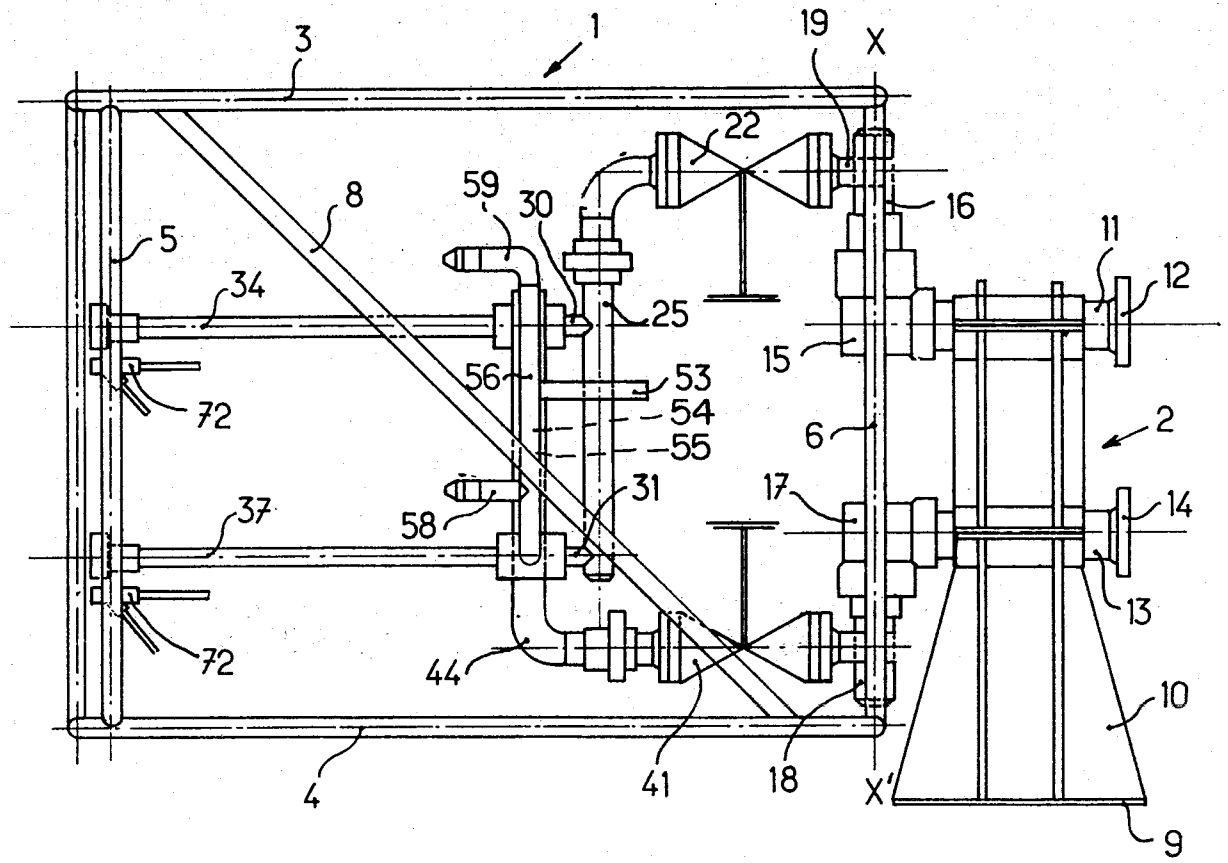
FIG. 2 shows, diagrammatically, a side view of the burner apparatus of FIG. 1.

In the drawings certain elements have been omitted for clarity but such omitted elements as are important in the operation of the device have been clearly identified and described hereunder.

As will be seen from the illustrations the burner assembly is contained within a substantially rectangular protective cage 1 and the burner assembly and cage are pivotally displaceable about a vertical axis X—X$^1$ relative to a fixed upright stand 2.

The cage 1, conveniently made from square tubing, is formed by upper and lower rectangular frames 3 and 4 respectively interconnected by front and rear uprights 5 and 6 respectively and the cage is strengthened by diagonal members 7 in frames 3 and 4 and by diagonal members 8 which extend between the frames 3 and 4.

The stand 2, includes a base flange 9 with plates 10 upstanding therefrom. A duct 11, for supplying oil to the assembly, passes through the stand 2 and presents a coupling 12 to which a duct (not shown) supplying oil to the burner can be attached. A duch 13, parallel to duct 11 and with its axis in the same vertical plane as duct 11, passes through the stand 2 and presents a coupling 14 for attachment of a compressed air supply duct (not shown). A duct (not shown) with a coupling thereon, for connection with a water supply duct, will also pass through the stand 2, in identical manner to ducts 11 and 13, between and parallel to the ducts 11 and 13 and with its axis in the same vertical plane as that passing through the axis of ducts 11 and 13. This water duct through stand 2, and its connections with the water supply ducting of the assembly to be described hereafter, has been omitted only for clarity in the drawings.

The duct 11, discharges into an elbow 15 the horizontal limb of which is fixed on duct 11 and the vertical limb of which opens upwardly. A coupling part 16 receives the upper open end of the vertical limb of part 15 with a fluid tight seal and part 16 is rotatable relative to part 15.

The duct 13 discharges into an elbow 17, the vertical limb of which opens downwardly, and a coupling part 18 receives the lower open end of the vertical limb of elbow 17 with a fluid tight seal and part 18 is rotatable relative to part 17.

In a similar manner the water supply duct (not shown) will discharge into an elbow (not shown) the vertical limb of which may open upwardly or downwardly and a coupling part (not shown) will receive the open end of the vertical limb of the elbow with a fluid tight seal, and the coupling will be rotatable relative to the vertical limb of the elbow.

It will now be seen that the vertical limb of elbow 15 and the coupling 16 define an oil chamber, the duct 11 discharges into the elbow 15 and the outlet to the oil chamber is via the coupling 16. The elbow 17 and coupling 18 define a compressed air chamber into which duct 13 discharges and from which air exhausts via coupling 18.

The axes of the fluid chambers defined by elbow 15 and coupling 16 and elbow 17 and coupling 18 and the chamber (not shown) defined by the water supply elbow and coupling, all lie concentric with the vertical axis X—X: The rotation of couplings 16, 18 and the water coupling is effected concentric with the axis X—X$^1$ and thus the supply of oil, compressed air, and water, to the assembly will be maintained for all positions of the cage 1 and the burner assembly about the vertical axis X—X$^1$.

The coupling 16 discharges oil from elbow 15 intoa manifold 19 which supplies oil via three valves 20, 21 and 22 to three generally upright manifolds 23, 24 and 25 respectively. Upper and lower outlets 26 and 27 respectively from manifold 23 supply crude oil to a first pair of burners 32 and 35 respectively, arranged with their axes substantially horizontally and in the same vertical plane, upper and lower outlets 28 and 29 respectively from manifold 24 supply crude oil to burners 33 and 36 respectively, arranged in like manner to burners 32 and 35, and upper and lower outlets 30 and 31 respectively from manifold 25 supply crude oil to burners 34 and 37 respectively arranged in like manner to burners 33 and 36. The burners 32, 33 and 34 lie in a common horizontal plane, the burners 35, 36 and 37 lie in a horizontal plane and, as burner pairs 32, 35 and 33, 36 and 34, 37 are controlled by valves 20, 21 and 22 respectively, each burner pair can be operated independently of the other pairs of burners. Pilots 72 are located adjacent the burners.

The coupling 18 discharges into a manifold 38 which supplies compressed air through valves 39, 40 and 41 to generally upright manifolds 42, 43 and 44 respectively. Manifolds 42 and 43 are omitted from FIG. 3 for clarity in FIG. 3. The manifold 42 discharges compressed air to burners 35 and 32 via outlets 45 and 48 respectively, manifold 43 discharges compressed air to burners 36 and 33 via oulets 46 and 49 respectively and manifold 44 discharges compressed air to burners 37 and 34 via oulets 47 and 50 respectively. Outlets 45, 46 and 48 and 49 have been omitted from FIG. 3.

Thus, valves 39, 40 and 41 individually control the air supply to burner pairs 32, 35 and 33, 36 and 34, 37 respectively.

Figure 3:
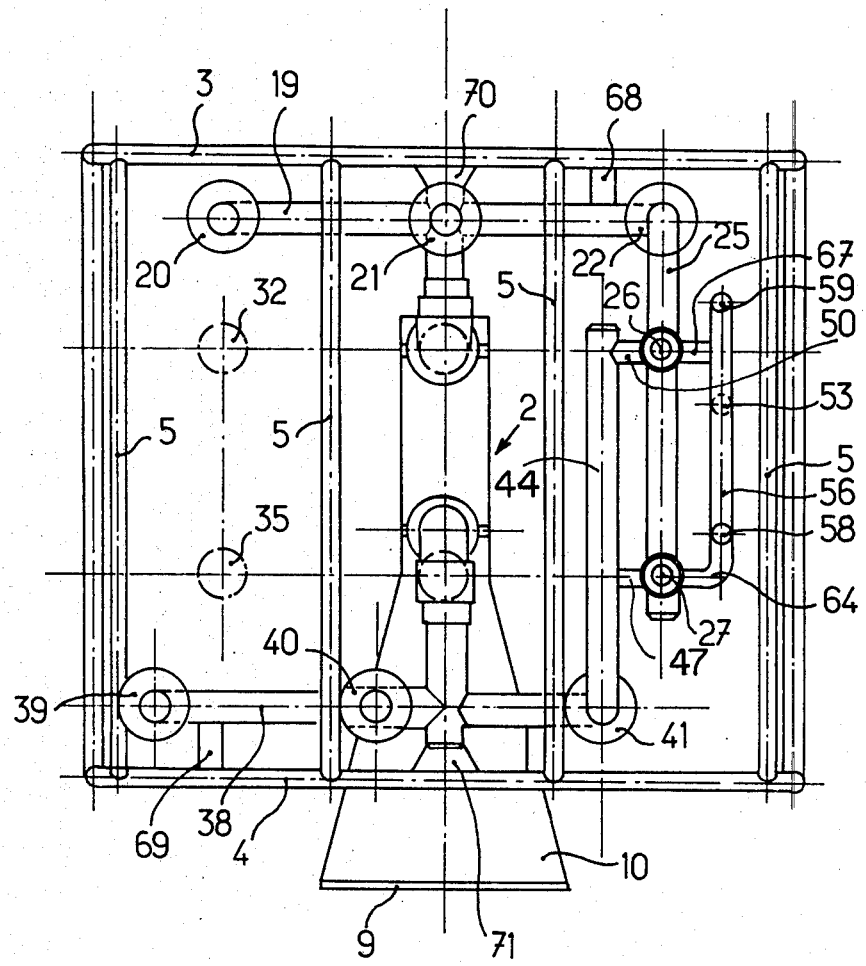
FIG. 3 shows, diagrammatically, a front view of the device.

In a similar manner to couplings 16 and 18 the coupling for the water duct discharges into a manifold which supplies water to three ducts 51, 52 and 53 (the ducts 51 and 52 are not shown in FIG. 3) which discharge to generally upright manifolds 54, 55 and 56 respectively (manifolds 54 and 55 and their attachments are not shown in FIG. 3). The manifolds 54,55 and 56 each have two outlets to water nozzles, the manifold 56 supplies water to upper and lower nozzles 59 and 58 respectively, manifold 55 supplies water to upper and lower nozzles 60 and 60*a* respectively and manifold 54 supplies water to upper and lower nozzles 61 and 61*a* respectively.

Thus, with the above described arrangement, nozzles 61, 60, 59, 61*a*, 60*a* and 58, are located adjacent burners 32, 33, 34, 35, 36 and 37, respectively and, in like manner to the oil and air supplies, the water supply to the water nozzles associated with each pair of burners can be controlled by a single valve (not shown for clarity in the drawings) independently of the other nozzles.

The nozzles 61, 60, 59, 61*a*, 60*a* and 58 are so directed relative to their respective burners 32 to 37 respectively that, when operable, the water jet from each nozzle can regulate the flame, and reduce smoke, from its respective burner.

It will now be seen that with the arrangement described above the burner can be operable with one, two or three pairs of burners so that the burner assembly can accommodate wide variations in the supply of oil thereto and, by adjusting the angular position of the burner assembly and cage relative to the stand, the most advantageous direction for the burner assembly can be obtained.

Whilst the present invention has been described by way of example with reference to a specific embodiment many variations and modifications will be apparent to persons skilled in the art within the scope of the appended claims and, by way of example, the cage may be of different construction, the valves and fluid supply ducts may be differently arranged from that illustrated and the burner assembly can be readily made vertically adjustable and, with the valves, made adjustable under the control of servomotors.

I claim:

1. An apparatus for use in burning crude oil produced in the course of conducting production tests at an oil well drilling installation, said apparatus comprising:

a pedestal adapted to be positioned at a drilling installation;

horizontal conduits extending through said pedestal, said conduits having at first ends thereof means for connection to separate supplies of air, water and crude oil to be burned;

each said conduit having connected to a second end thereof an elbow member having a vertical portion;

each said elbow member having in said vertical portion thereof a revolving coupling pivotally mounted with respect to said elbow member about a vertical axis;

all of said elbow members and said couplings being vertically aligned coaxially of said vertical axis;

a burner assembly fixedly connected to said couplings and horizontally pivotable therewith about said vertical axis with respect to said elbow members and said pedestal;

a cage fixed to and supported by said burner assembly and surrounding said burner assembly;

said burner assembly comprising a plurality of pairs of horizontal burners connected to said elbow members for receiving therefrom crude oil and air, and a plurality of horizontal water nozzles connected to one of said elbow members for receiving therefrom water, said burners of each said pair of burners being vertically spaced, said pairs of burners being horizontally spaced, and each said burner having positioned adjacent thereto a respective one of said water nozzles; and said burner assembly, said cage and said couplings being supported solely by said elbow members.

2. An apparatus as claimed in claim 1, further comprising a crude oil horizontal manifold connected to said coupling connected to said conduit for crude oil, and valve means connecting said crude oil horizontal manifold to each said pair of burners.

3. An apparatus as claimed in claim 2, wherein said coupling connected to said crude oil conduit opens upwardly into said crude oil horizontal manifold, and said crude oil horizontal manifold extends horizontally across substantially the entire width of said cage.

4. An apparatus as claimed in claim 3, further comprising a vertical crude oil manifold extending downwardly from each said valve means and connected to said burners of the respective said pair of burners.

5. An apparatus as claimed in claim 4, further comprising horizontal pipes extending from each said vertical crude oil manifold to said burners of each said pair of burners.

6. An apparatus as claimed in claim 1 or claim 2, further comprising an air horizontal manifold connected to said coupling connected to said conduit for air, and valve means connected said air horizontal manifold to each said pair of burners.

7. An apparatus as claimed in claim 6, wherein said coupling connected to said air conduit opens downwardly into said air horizontal manifold, and said air horizontal manifold extends horizontally across substantially the entire width of said cage.

8. An apparatus as claimed in claim 7, further comprising a vertical air manifold extending upardly from each said valve means and connected to said burners of the respective said pair of burners.

9. An apparatus as claimed in claim 8, further comprising horizontal pipes extending from each said vertical air manifold to said burners of each said pair of burners.

10. An apparatus as claimed in claim 6, wherein said burners of each said pair of burners are aligned in a vertical plane extending substantially transverse to said horizontal manifold.

11. An apparatus as claimed in claim 1, wherein said cage comprises horizontally extending lower and upper rectangular frames, vertical uprights connecting said lower and upper frames, diagonal braces connecting said lower and upper frames, and horizontal cross bars extending in the planes of and stiffening said lower and upper frames.

12. An apparatus as claimed in claim 1, wherein each said water nozzle is positioned laterally adjacent the respective said burner at a location above the axis thereof.

13. An apparatus as claimed in claim 1, further comprising a plurality of pilot burners supported by said cage, each said pilot burner being positioned adjacent a respective said burner.

* * * * *